US011313203B2

(12) United States Patent
Walton et al.

(10) Patent No.: US 11,313,203 B2
(45) Date of Patent: Apr. 26, 2022

(54) ELECTRONIC INITIATOR SLEEVES AND METHODS OF USE

(71) Applicant: Halliburton Energy Services, Inc., Houston, TX (US)

(72) Inventors: Zachary William Walton, Carrollton, TX (US); Matthew James Merron, Carrollton, TX (US); Michael Linley Fripp, Carrollton, TX (US); Raymundus Jozef Meijs, Centennial, CO (US); Matthew Bryan Roseman, Lancaster, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 80 days.

(21) Appl. No.: 16/757,127

(22) PCT Filed: Dec. 6, 2017

(86) PCT No.: PCT/US2017/064931
§ 371 (c)(1),
(2) Date: Apr. 17, 2020

(87) PCT Pub. No.: WO2019/112579
PCT Pub. Date: Jun. 13, 2019

(65) Prior Publication Data

US 2020/0248531 A1 Aug. 6, 2020

(51) Int. Cl.
*E21B 34/06* (2006.01)
*E21B 34/08* (2006.01)
(Continued)

(52) U.S. Cl.
CPC ..... *E21B 34/066* (2013.01); *E21B 33/12* (2013.01); *E21B 34/08* (2013.01); *E21B 34/103* (2013.01); *E21B 47/12* (2013.01)

(58) Field of Classification Search
CPC ..... E21B 34/066; E21B 34/08; E21B 34/103; E21B 47/12
See application file for complete search history.

(56) References Cited

U.S. PATENT DOCUMENTS 9,010,442 B2 4/2015 Streich et al.
9,051,810 B1 * 6/2015 Cuffe ..... E21B 34/10
(Continued)

FOREIGN PATENT DOCUMENTS

CN 106121599 A 11/2016
EP 2630327 B1 8/2013
(Continued)

OTHER PUBLICATIONS

Examination Report mailed in related Indian Patent Application No. 202027009340, dated Mar. 23, 2021, 8 pages.
(Continued)

*Primary Examiner* — Matthew R Buck
(74) *Attorney, Agent, or Firm* — Scott Richardson; Baker Botts L.L.P.

(57) ABSTRACT

Apparatuses, systems, and methods for performing wellbore completion and production operations in a subterranean formation are provided. In some embodiments, the methods include: disposing an electronic initiator sleeve within a closed wellbore penetrating at least a portion of a subterranean formation, wherein the electronic initiator sleeve comprises: a housing having at least one port, a sleeve in a closed position, an actuator, and at least one sensor; increasing fluid pressure within the closed wellbore for a period of time, wherein the sleeve remains in the closed position during the period of time; detecting a signal with the at least one sensor; and actuating the actuator in response to the signal to transition the sleeve from the closed position to an open position.

20 Claims, 4 Drawing Sheets

(51) Int. Cl.

| | |
|---|---|
| ***E21B 34/10*** | (2006.01) |
| ***E21B 47/12*** | (2012.01) |
| ***E21B 33/12*** | (2006.01) |

(56) References Cited

U.S. PATENT DOCUMENTS

| | | | | |
|---|---|---|---|---|
| 9,279,310 | B2 | 3/2016 | Howell et al. | |
| 9,506,324 | B2 | 11/2016 | Kyle et al. | |
| 9,587,486 | B2 | 3/2017 | Walton et al. | |
| 2007/0204995 | A1* | 9/2007 | Hofman | E21B 43/14 166/308.1 |
| 2013/0220603 | A1 | 8/2013 | Robison et al. | |
| 2014/0000909 | A1* | 1/2014 | Neer | E21B 34/108 166/373 |
| 2016/0090815 | A1 | 3/2016 | Kennedy | |
| 2016/0177673 | A1 | 6/2016 | Merron et al. | |
| 2016/0208578 | A1 | 7/2016 | Guzman et al. | |
| 2016/0237781 | A1 | 7/2016 | Bacsik et al. | |
| 2016/0230505 | A1 | 8/2016 | Garcia et al. | |
| 2016/0237785 | A1 | 8/2016 | Bacsik et al. | |
| 2016/0265310 | A1* | 9/2016 | Getzlaf | E21B 34/103 |
| 2016/0312579 | A1* | 10/2016 | Green | E21B 47/14 |

FOREIGN PATENT DOCUMENTS

| | | | |
|---|---|---|---|
| GB | 2433083 | A | 6/2007 |
| WO | 2017/027978 | A1 | 2/2017 |

OTHER PUBLICATIONS

International Preliminary Report on Patentability mailed in related PCT Application No. PCT/US2017/064931 dated Jun. 9, 2020, 11 pages.

International Search Report and Written Opinion issued in related PCT Application No. PCT/US2017/064931 dated Aug. 31, 2018, 13 pages.

Search Report issued in related Chinese Patent Application No. 2017800952849 completed Jun. 24, 2021, 2 pages.

Written Opinion and Search Report issued in related Singapore Patent Application No. 11202001894W completed Sep. 3, 2021, 8 pages.

* cited by examiner

ELECTRONIC INITIATOR SLEEVES AND METHODS OF USE

CROSS-REFERENCE TO RELATED APPLICATION

The present application is a U.S. National Stage Application of International Application No. PCT/US2017/064931 filed Dec. 6, 2017, which is incorporated herein by reference in its entirety for all purposes.

BACKGROUND

Hydrocarbons, such as oil and gas, are commonly obtained from subterranean formations that may be located onshore or offshore. The development of subterranean operations and the processes involved in removing hydrocarbons from a subterranean formation may involve a number of different steps such as, for example, drilling a wellbore at a desired well site, treating the wellbore to optimize production of hydrocarbons, and performing the necessary steps to produce and process the hydrocarbons from the subterranean formation.

After a wellbore has been formed, various downhole tools may be inserted into the wellbore to extract the natural resources such as hydrocarbons or water from the wellbore, to inject fluids into the wellbore, and/or to maintain the wellbore. It is common practice in completing oil and gas wells to set a string of pipe, known as a casing string, in the wellbore and to cement around the outside of the casing to isolate the various formations penetrated by the well. The casing string may include various wellbore tools.

After cementing of the casing is complete, the bottom of the wellbore must be re-opened to establish fluid communication between the hydrocarbon-bearing formations and the interior of the casing. It often may be desirable to test the integrity of the casing prior to re-opening the wellbore. The casing integrity testing and the re-opening of the wellbore may be done with a wellbore tool commonly referred to as a "toe sleeve" or "initiator sleeve," which is commonly located at the toe of the casing string.

BRIEF DESCRIPTION OF THE DRAWINGS

These drawings illustrate certain aspects of some of the embodiments of the present disclosure, and should not be used to limit or define the claims.

While embodiments of this disclosure have been depicted, such embodiments do not imply a limitation on the disclosure, and no such limitation should be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DESCRIPTION OF CERTAIN EMBODIMENTS

The present disclosure relates to apparatuses, systems, and methods for performing wellbore completion and production operations in a subterranean formation. More particularly, the present disclosure relates to electronic initiator sleeves and systems for initiating fluid flow from closed wellbores into subterranean formations using signals.

The present disclosure provides one or more electronic initiator sleeves comprising a housing having at least one port, a sleeve disposed within the housing, an actuator disposed within the housing, and a sensor coupled to the housing. The electronic initiator sleeves may be disposed within a closed wellbore penetrating at least a portion of a subterranean formation. The electronic initiator sleeves may be incorporated within a tubular string disposed within the closed wellbore. The sleeve of the electronic initiator sleeve may be configured to transition from a closed position to an open position to establish a route of fluid communication between the closed wellbore and the subterranean formation. In certain embodiments, the sleeve may remain in the closed position during the performance of a casing integrity test to prevent fluid flow from the closed wellbore to the subterranean formation. In certain embodiments, the sensor of the electronic initiator sleeve may detect a signal and the actuator of the electronic initiator sleeve may actuate in response to the signal to transition the sleeve from the closed position to the open position and initiate fluid flow from the closed wellbore to the subterranean formation.

Among the many potential advantages to the apparatuses, systems, and methods of the present disclosure, only some of which are alluded to herein, the apparatuses, systems, and methods of the present disclosure may facilitate the performance of casing integrity testing with minimal risk of exceeding test pressure or inadvertently opening the initiator sleeve. In certain embodiments, the systems, apparatuses, and methods of the present disclosure may provide the ability to stop and resume casing integrity testing with no time limit, which may allow for remedial cementing operation to be completed, if necessary. In certain embodiments, the apparatuses, systems, and methods of the present disclosure may also facilitate interventionless means to create a flow path at the toe of a wellbore penetrating a subterranean formation.

Figure 1A:
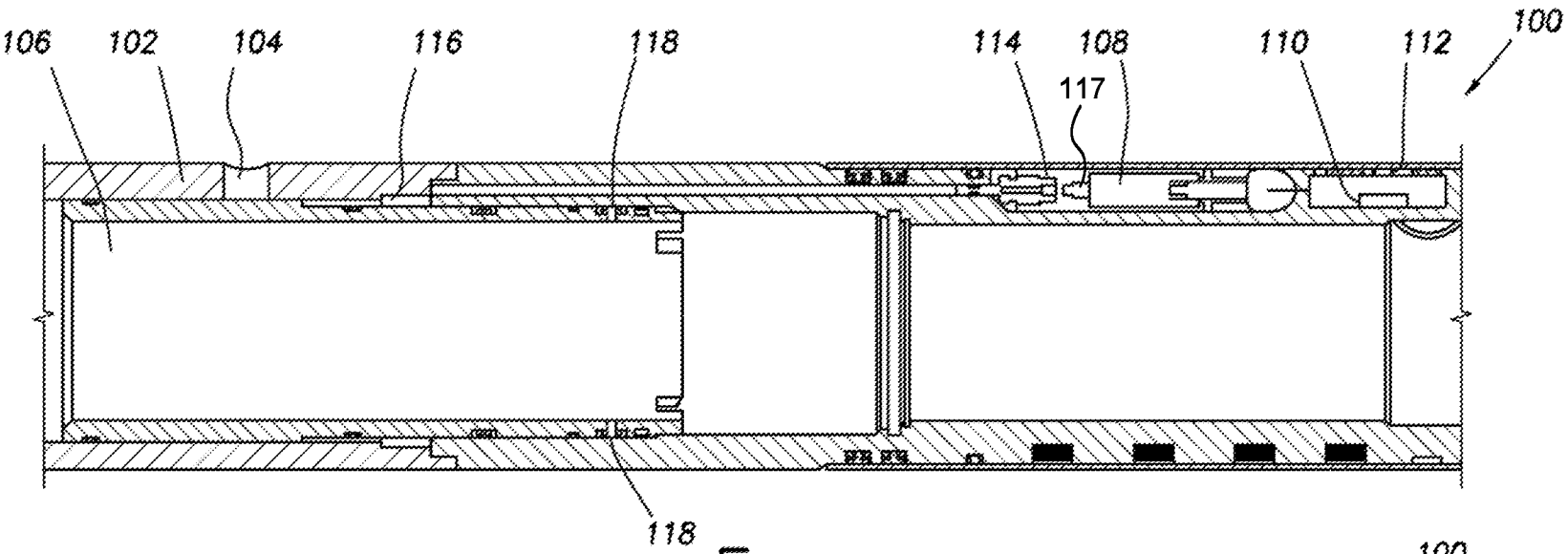
FIGS. 1A-B are schematic views of an electronic initiator sleeve in accordance with certain embodiments of the present disclosure.
Figure 1B:
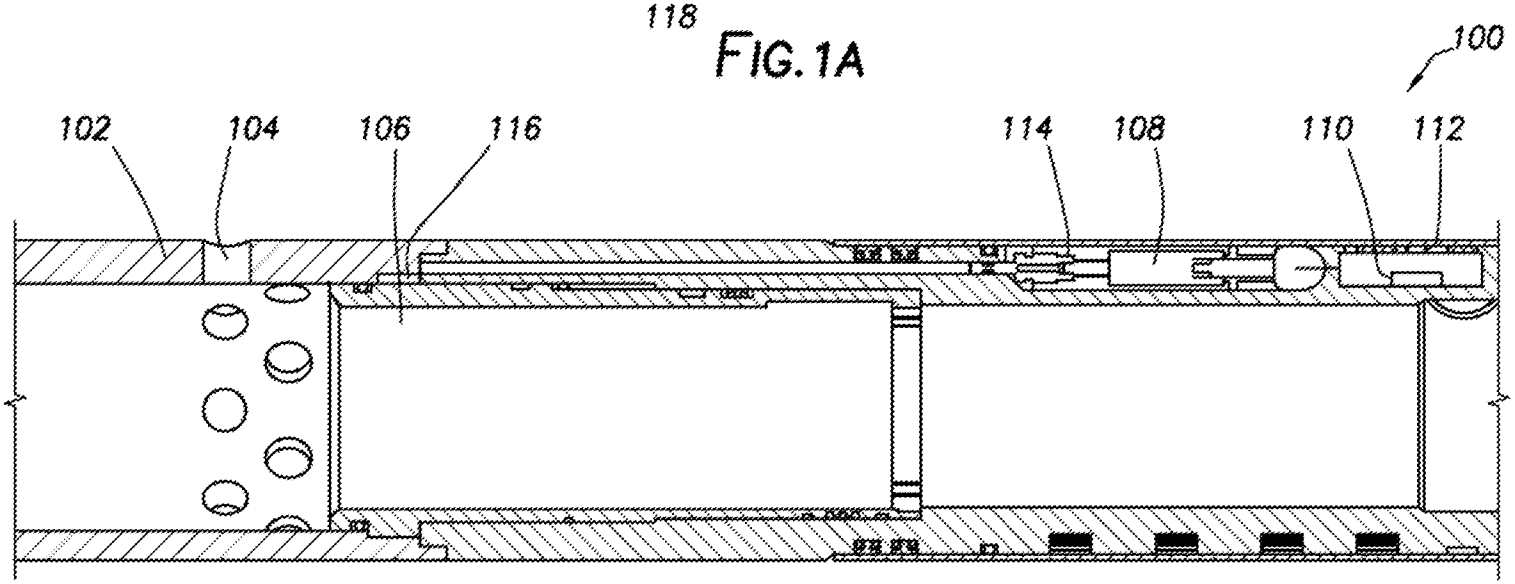
Figure 2A:
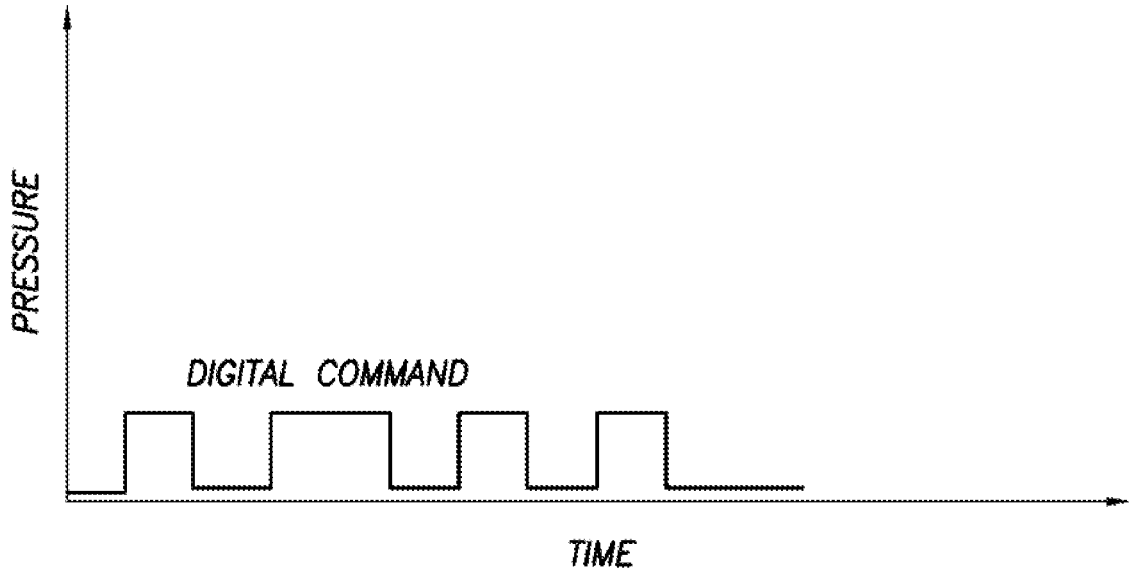
FIGS. 2A-D are graphs depicting predetermined signals in accordance with certain embodiments of the present disclosure.
Figure 2B:
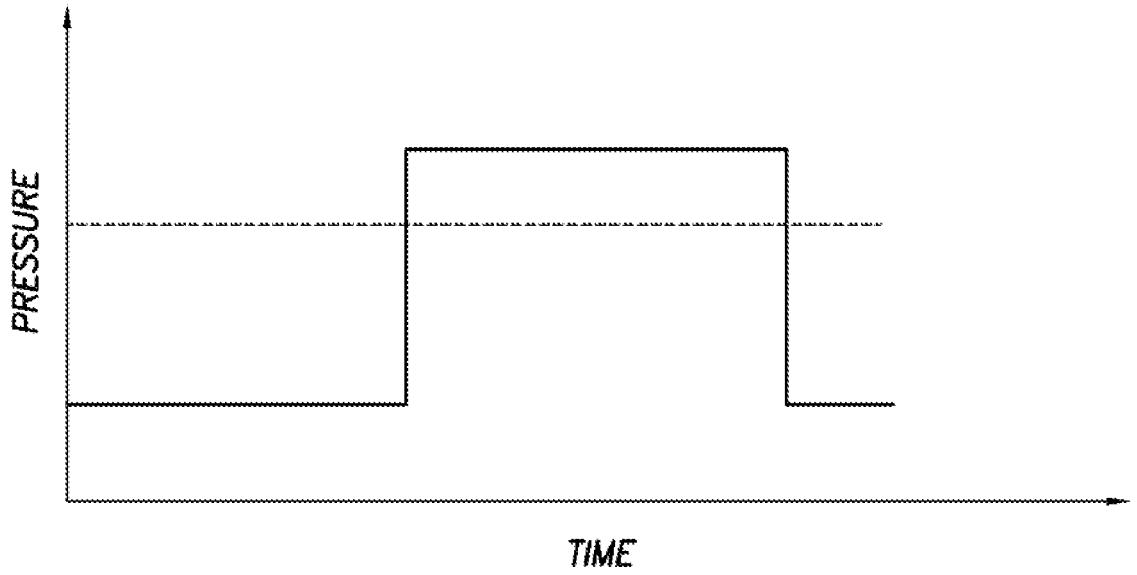
Figure 2C:
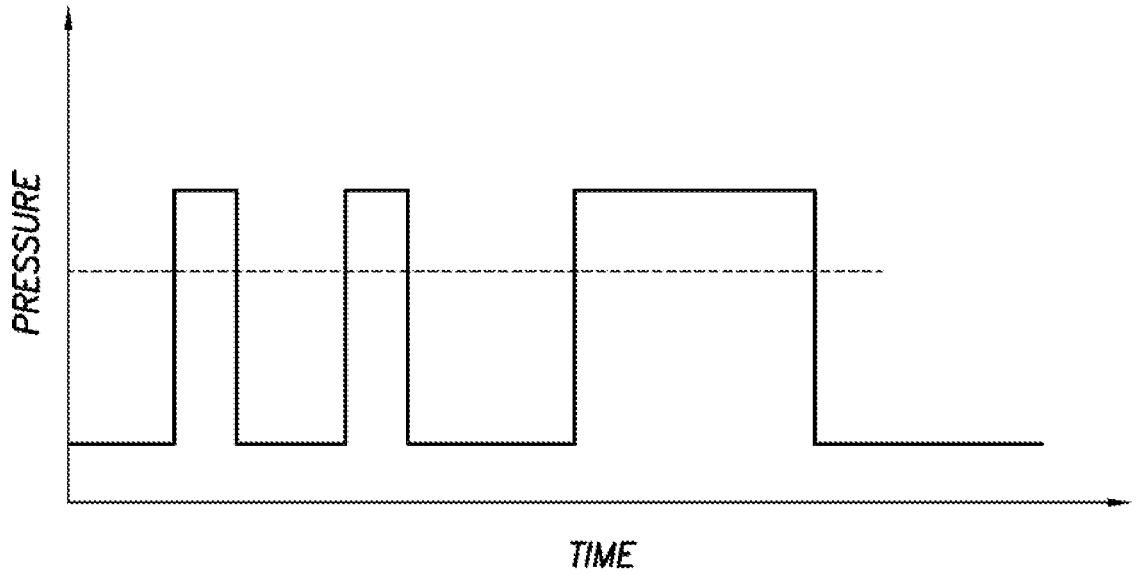
Figure 2D:
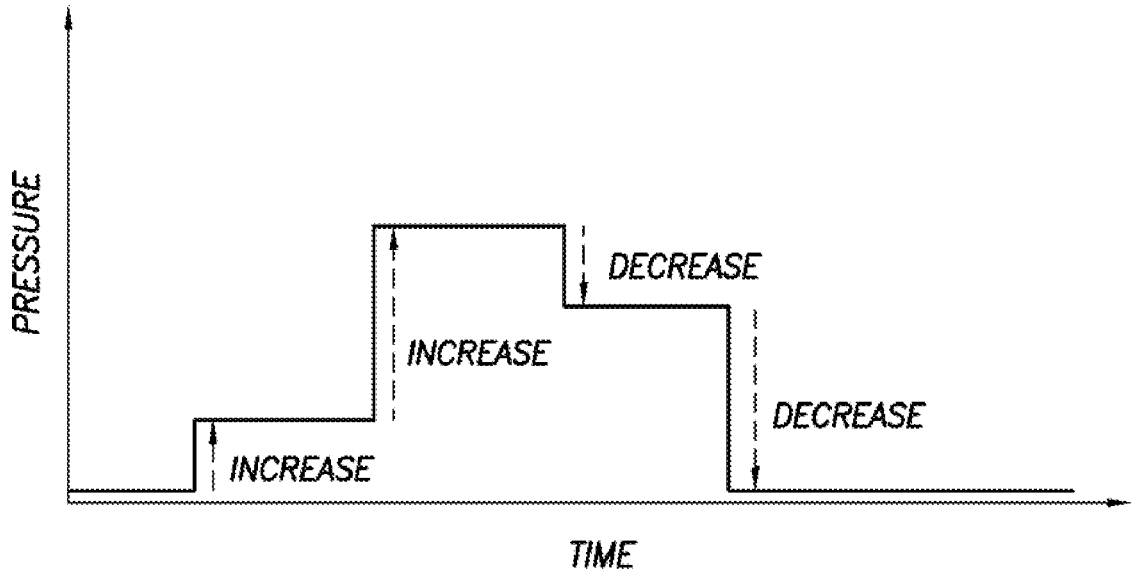
Figure 3:
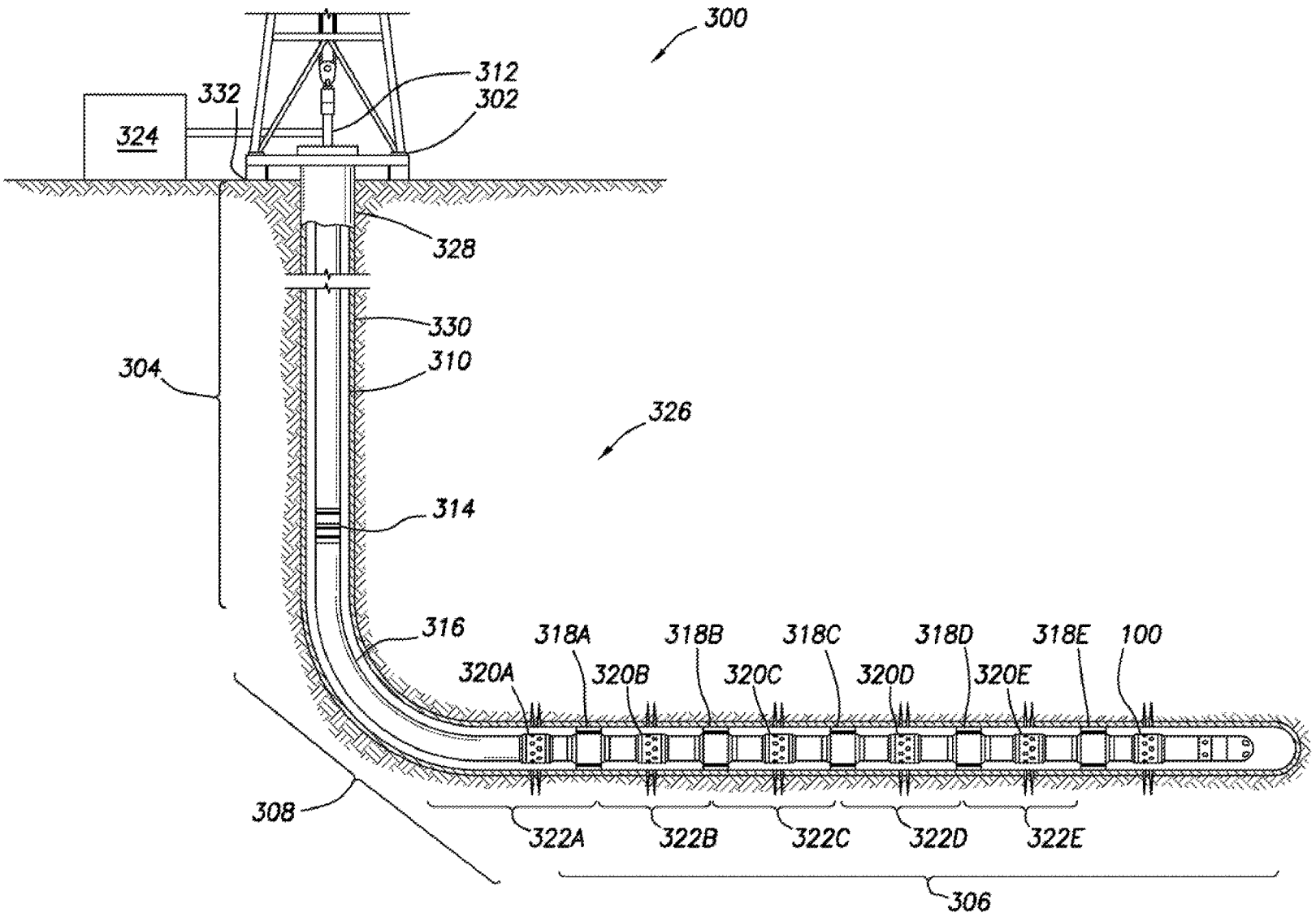
FIG. 3 is a schematic of a well system in accordance with certain embodiments of the present disclosure.

Embodiments of the present disclosure and its advantages may be understood by referring to FIGS. 1 through 3, where like numbers are used to indicate like and corresponding parts. FIGS. 1A and 1B depict an electronic initiator sleeve 100 in accordance with certain embodiments of the present disclosure. FIG. 1A depicts electronic initiator sleeve 100 in a closed position while FIG. 1B depicts electronic initiator sleeve 100 in an open position. Electronic initiator sleeve 100 may comprise a housing 102 having at least one port 104, a sleeve 106, an actuator 108, and a sensor 110. Actuator 108 may comprise any suitable actuator including, but not limited to, an electromagnetic device (e.g., a motor, gearbox, or linear screw), a solenoid actuator, a piezoelectric actuator, a hydraulic pump, a chemically activated actuator, a heat activated actuator, a pressure activated actuator, or any combination thereof. In certain embodiments, for example, actuator 108 may be a linear actuator that retracts or extends a pin for permitting or restricting movement of a component of electronic initiator sleeve 100. Sensor 110 may comprise any suitable sensor including, but not limited to, a pressure sensor, a temperature sensor, a pH sensor, a flow sensor, a hydrophone, a vibrational sensor, an acoustic sensor, an accelerometer, a piezoelectric sensor, a strain gauge, or any combination thereof.

In certain embodiments, electronic initiator sleeve 100 may also comprise on-board electronics 112 which may include, for example, a controller, a processor, memory, or any combination thereof. Actuator 108, on-board electronics 112, or both may be supplied with electrical power via an on-board battery, a downhole generator, or any other electrical power source. In certain embodiments, one or more of the actuator 108, sensor 110, and on-board electronics 112 may be fully disposed within housing 102. In other embodiments, one or more of the actuator 108, sensor 110, and on-board electronics 112 may be partially disposed within housing 102. In yet other embodiments, one or more of the actuator 108, sensor 110, and on-board electronics 112 may be positioned on, about, or external to housing 102.

Sensor 110 may detect a signal. In certain embodiments, the signal may be generated by adjusting one or more conditions within a closed wellbore including, but not limited to, the pressure, the temperature, the pH, the flow rate, the acoustic vibration, the magnetic field, and the electromagnetic field. In certain embodiments, the signal may comprise a pulse width modulated signal, a signal varying threshold values, a ramping signal, a sine waveform signal, a square waveform signal, a triangle waveform signal, a sawtooth waveform signal, the like, or combinations thereof. Further, the waveform may exhibit any suitable duty-cycle, frequency, amplitude, duration, or combinations thereof. In certain embodiments, the signal may comprise a sequence of one or more predetermined threshold values, a predetermined discrete threshold value, a predetermined series of ramping signals, a predetermined pulse width modulated signal, any other suitable waveform as would be appreciated by one of skill in the art, or combinations thereof. Although signals are discussed herein, a person of ordinary skill in the art with the benefit of this disclosure will appreciate that the one or more signals may be wired signals, wireless signals, or both.

In certain embodiments, sensor 110 may convert the signal into an electrical signal. In certain embodiments, on-board electronics 112 may receive one or more electrical signals from sensor 110 based on the signal. On-board electronics 112 (e.g., a controller) may execute instructions based, at least in part, on the electrical signal. One or more of the instructions executed by on-board electronics 112 may cause on-board electronics 112 (e.g., a processor) to send one or more signals to actuator 108 thereby causing actuator 108 to actuate. Thus, in certain embodiments, actuator 108 may actuate based, at least in part, on the signal detected by sensor 110.

In certain embodiments, on-board electronics 112 may communicate with sensor 110, actuator 108, or both directly or indirectly, wired or wirelessly. For example, in one or more embodiments on-board electronics 112 may communicate via one or more wires including, but not limited to, solid core copper wires, insulated stranded copper wires, unshielded twisted pairs, fiber optic cables, coaxial cables, any other suitable wires as would be appreciated by one of skill in the art, or combinations thereof. In certain embodiments, on-board electronics 112 may communicate with sensor 110, actuator 108, or both via one or more signaling protocols including, but not limited to, an encoded digital signal.

In certain embodiments, sensor 110 may be configured to detect a predetermined wireless signal and to communicate a corresponding electrical signal to on-board electronics 112. In one or more embodiments, the predetermined signal may comprise or be indicative of one or more predetermined threshold values, a predetermined discrete threshold value, a predetermined series of ramping signals, a predetermined pulse width modulated signal, or any combination thereof. On-board electronics 112 may instruct actuator 108 to actuate based, at least in part, on the electrical signal received from sensor 110. In certain embodiments, on-board electronics 112 may send an actuation signal corresponding to the electrical signal received from sensor 110 to actuator 108 instructing actuator 108 to actuate.

For instance, in one embodiment, sensor 110 may detect a predetermined signal in the form of a rise in hydrostatic pressure from an original pressure (for example, an original pressure of about 100 pounds per square inch (psi) (approximately 689.48 kiloPascal (kPa)) to one or more first measured pressures (for example, one or more first measured pressures between about 200 psi (approximately 1378.95 kPa) and about 400 psi (approximately 2757.9 kPa) for a first time period $t_1$ (for example, $t_1$ may be a time period of about 8 to 10 minutes, or any other range of time period) followed by a rise to one or more second measured pressures (for example, one or more second measured pressures between about 600 psi (approximately 4136.85 kPa) and about 800 psi (approximately 4136.85 kPa)) for a second time period $t_2$ (for example, $t_2$ may be a second time period of about 8 to 10 minutes, or any other range of time) and then a return to the original pressure. Once the predetermined signal is detected, sensor 110 may send a corresponding electrical signal to on-board electronics 112, which may in turn send a corresponding actuation signal to actuator 108 instructing actuator 108 to actuate.

In certain embodiments, there may be a time delay between receipt of the predetermined signal by sensor 110 and communication of a corresponding electrical signal to on-board electronics 112. In certain embodiments, there may be a time delay between receipt of the electrical signal by on-board electronics 112 and communication of a corresponding actuation signal to actuator 108. Thus, in certain embodiments, there may be a time delay between detection of the predetermined signal by sensor 110 and actuation of actuator 108. For instance, sensor 110 may detect the predetermined signal and promptly communicate a corresponding electrical signal to on-board electronics 112, and on-board electronics 112 may wait a time period (or time delay) before sending a corresponding actuation signal to actuator 108. In such embodiments, receipt of the electrical signal by on-board electronics 112 may initiate a timer, and the corresponding actuation signal may be sent to actuator 108 upon expiration of the timer. One of skill in the art with the benefit this disclosure will recognize the appropriate length of the time delay.

FIGS. 2A-D graphically depict examples of predetermined signals in accordance with certain embodiments of the present disclosure. The predetermined signals in FIGS. 2A-D are merely illustrative and do not limit the appropriate types of predetermined signals. Furthermore, although the predetermined signals in FIGS. 2A-D are depicted using pressure signals, any suitable predetermined signal may be used in the electronic initiator sleeves of the present disclosure, including, but not limited to temperature signals, pH signals, flow rate signals, acoustic vibration signals, magnetic field signals, and electromagnetic field signals, or combinations thereof. In one or more embodiments, the predetermined signals may be wired or wireless signals.

FIG. 2A depicts a predetermined signal based on a series of pressure pulses. For predetermined signals based on pulses, the on-board electronics 112 may be configured to execute instructions in response to different quantities or patterns of pulses. For example, on-board electronics 112 may respond to a total quantity of pulses, a specific number of pulses within a period of time, a delay between pulses, a specific pattern of pulses and delays, or any similar signal.

Although FIG. 2A depicts a binary predetermined signal of low and high values, the predetermined signal could be non-binary.

FIG. 2B depicts a predetermined signal based on a pressure exceeding a threshold value. For predetermined signals based on a threshold value of a wellbore condition (e.g., pressure), on-board electronics 112 may be configured to execute instructions in response to being above a threshold value, being within a range of values, remaining under a threshold value, or crossing a threshold value a certain number of times.

FIG. 2C depicts a predetermined signal based on the duration or dwell time of one or more pressures. For predetermined signals based on duration or dwell time of a wellbore condition (e.g., pressure), the on-board electronics 112 may be configured to execute instructions in response to the wellbore condition being at, above, or below a particular value for a particular period of time, or in response to the absence of the wellbore condition for a particular period of time or both.

FIG. 2D depicts a predetermined signal based on increases and decreases in pressure. For predetermined signals based on increases and/or decreases of a wellbore condition (e.g., pressure), the on-board electronics 112 may be configured to execute instructions in response to, for example, a specific pattern of the wellbore condition over time, the amount of change in the wellbore condition, the duration over which the wellbore condition remains changed, or whether the wellbore condition increased, decreased, or both more than a threshold value. The increase and/or decrease of the wellbore condition may be independent of the absolute magnitude of the increase or decrease, so long as the increase or decrease in wellbore condition is above a threshold amount.

In certain embodiments, actuator 108 may actuate to move one or more components of electronic initiator sleeve 100 in response to the output from on-board electronics 112 to transition sleeve 106 from a closed position (FIG. 1A) to an open position (FIG. 1B). In certain embodiments, as shown in FIG. 1A, electronic initiator sleeve 100 may comprise a hydraulic chamber 116 comprising oil and an electro-hydraulic lock that comprises, for instance, a rupture disk 114 and a piercing mechanism 117. In such embodiments, the electro-hydraulic lock may hold sleeve 106 in the closed position under the electro-hydraulic lock is removed. In such embodiments, the electro-hydraulic lock may be removed by actuator 108 moving piercing mechanism 117 in response to the output from on-board electronics 112 based on the predetermined signal detected by sensor 110 thereby causing it to break (e.g., rupture, puncture, and/or perforate) rupture disk 114, as shown in FIG. 1B. The oil may evacuate hydraulic chamber 116 upon the breaking of rupture disk 114 creating a pressure imbalance that causes sleeve 106 to transition from the closed position to the open position. Alternatively, in certain embodiments, electronic initiator sleeve 100 may comprise a valve connected to hydraulic chamber 116 that holds sleeve 106 the closed position while the valve is closed. In such embodiments, actuator 108 may open the valve in response to the output from on-board electronics 112 based on the predetermined signal detected by sensor 110 thereby causing the oil to evacuate hydraulic chamber 116. A pressure imbalance may result causing sleeve 106 to transition from the closed position to the open position.

In other embodiments, electronic initiator sleeve 100 may comprise a compressed spring connected to sleeve 106 and actuator 108 that holds sleeve 106 in the closed position when compressed. In such embodiments, actuator 108 may release the compressed spring in response to the output from on-board electronics 112 based on the predetermined signal detected by sensor 110 thereby causing sleeve 106 to transition from a closed position to an open position. In other embodiments, electronic initiator sleeve 100 may comprise a baffle connected to sleeve 106, and actuator 108 may be coupled to a valve. In such embodiments, actuator 108 may open the value in response to the output from on-board electronics 112 based on the predetermined signal detected by sensor 110 causing a ball to be released down the closed wellbore. The ball may contact the baffle thereby causing sleeve 106 to transition from a closed position to an open position.

In other embodiments, sleeve 106 and actuator 108 may be coupled to one or more motors. In such embodiments, actuator 108 drive the one or more motors in response to the output from on-board electronics 112 based on the predetermined signal detected by sensor 110 thereby causing sleeve 106 to transition from a closed position to an open position. In other embodiments, sleeve 106 and actuator 108 may be coupled to one or more pumps. In such embodiments, actuator 108 drive the one or more pump in response to the output from on-board electronics 112 based on the predetermined signal detected by sensor 110 thereby causing a fluid to be pumped into the closed wellbore. The fluid may cause the sleeve 106 to transition from a closed position to an open position. The electronic initiator sleeves, systems, and methods of the present disclosure may utilize any combination of the foregoing embodiments to transition sleeve 106 from the closed position to the open position.

In certain embodiments, as shown in FIG. 1A, electronic initiator sleeve 100 may also comprise one or more shear pins 118. In such embodiments, shear pins 118 may shear or break once the pressure inside electronic initiator sleeve 100 reaches a predetermined pressure. The combination of shear pins 118 with actuator 108 may prevent sleeve 106 from prematurely transitioning from the closed position to the open position. For instance, in one embodiment, electronic initiator sleeve 100 may comprise one or more shear pins 118 and a hydroelectric lock as described above. In such embodiment, the hydroelectric lock may be removed as described above permitting sleeve 106 to transition from the closed position to the open position. However, shear pins 118 may prevent sleeve 106 from transition to the open position until the pressure inside electronic initiator sleeve 100 reaches a predetermined pressure that is sufficient to shear or break shear pins 118.

FIG. 3 is a schematic of a well system 300 following a multiple-zone completion operation. A wellbore 328 extends from a surface 332 and through a subterranean formation 326. The wellbore 328 has a substantially vertical section 304 and a substantially horizontal section 306, vertical section 304 and horizontal section 306 being connected by a bend 308. Horizontal section 306 extends through a hydrocarbon bearing subterranean formation 326. One or more casing strings 310 are inserted and cemented into the wellbore 328 to prevent fluids from entering the wellbore. Fluids may comprise any one or more of formation fluids (such as production fluids or hydrocarbons), water, mud, fracturing fluids, or any other type of fluid that may be injected into or received from subterranean formation 326.

Although the wellbore 328 shown in FIG. 1 includes vertical section 304 and horizontal section 306, the wellbore 328 may be substantially vertical (for example, substantially perpendicular to the surface 332), substantially horizontal (for example, substantially parallel to the surface 332), or may comprise any other combination of horizontal and vertical sections. While a land-based system 300 is illustrated in FIG. 3, electronic initiator sleeves incorporating teachings of the present disclosure may be satisfactorily used with drilling equipment located on offshore platforms, drill ships, semi-submersibles, and drilling barges (not expressly shown). One or more casing strings 310 may extend into the wellbore 328 from a wellhead 312.

Well system 300 depicted in FIG. 3 is generally known as a closed wellbore in which one or more casing strings 310 are inserted in vertical section 304, bend 308, and horizontal section 306 and cemented in place with a cement sheath 330 surrounding casing strings 310. As used herein, the term "closed wellbore" refers to a wellbore comprising a substantially unperforated or unbroken cement sheath in which there is no substantial fluid flowing from the wellbore into to the subterranean formation. In some embodiments, the wellbore 328 may be partially completed (for example, partially cased or cemented) and partially uncompleted (for example, uncased and/or uncemented). In other embodiments, the wellbore 328 may be open if casing strings 310 do not extend through bend 308 and/or horizontal section 306 of the wellbore 328.

The embodiment in FIG. 3 includes a top production packer 314 disposed in the vertical section 304 of the wellbore that seals against an innermost surface of the casing string 310. A tubular string 316 extends from wellhead 312 along the wellbore. Tubular string 316 may be a casing string, a liner, a work string, a coiled tubing string, or other tubular string as will be appreciated by one of skill in the art with the benefit of this disclosure. Tubing string 316 may also be used to inject fluids into the formation 326 via the wellbore. Tubular string 316 may include multiple sections that are coupled or joined together by any suitable mechanism to allow tubular string 316 to extend to a desired or predetermined depth in the wellbore.

Electronic initiator sleeve 100 may be configured for incorporation into tubular string 316 or another suitable tubular string. Although only one electronic initiator sleeve is depicted in FIG. 3, multiple electronic initiator sleeves may be utilized in a single wellbore. In such embodiment, housing 102 may comprise a suitable connection (e.g., an internal or external threaded surfaces) to allow for its incorporation into tubular string 316. Other suitable connections will be known to those of skill in the art with the benefit of this disclosure. As shown in FIG. 3, in certain embodiments, electronic initiator sleeve 100 may be positioned on or about tubular string 316 at a location farthest from wellhead 312. In other words, electronic initiator sleeve 100 may be the first or initial tool on tubular string 316.

In certain embodiments, electronic initiator sleeve 100 may be incorporated into a plug and perforation system. In other embodiments, electronic initiator sleeve 100 may be incorporated into a multi-stage fracturing system. In these embodiments, various other downhole tools may be disposed along tubular string 316 as would be appreciated by one of skill in the art with the benefit of this disclosure. Such downhole tools include, but are not limited to, barriers 318A-E and sleeves 320A-E. Barriers 318A-E engage the inner surface of horizontal section 306, dividing the horizontal section 306 into a series of production zones 320A-F. In some embodiments, suitable barriers 318A-E include, but are not limited to packers (e.g., compression set packers, swellable packers, inflatable packers), cement, any other downhole tools, equipment, or devices for isolating zones, or any combination thereof.

The operation of electronic initiator sleeve 100 will now be described. In certain embodiments, electronic initiator sleeve 100 may be disposed within a closed wellbore penetrating at least a portion of subterranean formation 326, as illustrated in FIG. 3. In certain embodiments, it may be desirable to test the integrity of casing string 310 in the closed wellbore 328 prior to establishing fluid communication between the closed wellbore 328 and subterranean formation 326. In such embodiments, the pressure inside the closed wellbore 328 may be increased for a period of time. One of skill in the art with the benefit of this disclosure will recognize the appropriate pressures and time periods at which to test the integrity of casing string 310.

In certain embodiments, one or more wellbore conditions as described above may be adjusted following the casing integrity test to generate one or more signals. Various types of equipment may be located at well surface 332, well site 302, or within the wellbore 328 and used to generate a predetermined signal, for example, a wireless signal. Such equipment includes, but is not limited to, a rotary table, completion, drilling, or production fluid pumps, tools or devices that can provide pressure and/or bleed off pressure, any tools or devices capable of generating an acoustic signal, fluid tanks and other completion, drilling, or production equipment. For example, well system 300 may include a well flow control 324. Well flow control 324 may include, without limitation, valves, sensors, instrumentation, tubing, connections, chokes, bypasses, any other suitable components to control fluid flow into and out of the wellbore 328, or any combination thereof. In operation, well flow control 324 controls the flow rate of one or more fluids. In one or more embodiments, an operator or well flow control 324 or both may regulate the pressure in the wellbore 328 by adjusting the flow rate of a fluid into the wellbore 328. Similarly, an operator or controller or both may adjust other wellbore conditions using various types of equipment located at the well surface 332, well site 302, or within the wellbore 328 to generate the predetermined signal as would be appreciated by one of skill in the art.

As described above, actuator 108 may be actuated in response to the predetermined signal to transition sleeve 106 from a closed position to an open position. In such embodiments, a route of fluid communication from the closed wellbore 328 to subterranean formation 326 may be established through port 104 of electronic initiator sleeve 100. For example, this route of fluid communication may be an initial route of fluid communication. In certain embodiments, the route of fluid communication may break the cement sheath 330 to establish fluid flow between the wellbore 328 and subterranean formation 326. In certain embodiments, this may be the first or initial route of fluid communication established between the closed wellbore 328 to the subterranean formation 326 thereby opening the closed wellbore 328. In certain embodiments, a dissolvable plug may be exposed when sleeve 106 transitions from a closed position to an open position. In such embodiments, the dissolvable plug may be located in port 104 of electronic initiator sleeve 100. In such embodiments, the fluid in the wellbore 328 may at least partially dissolve the dissolvable plug before the route of fluid communication is established between the closed wellbore 328 and subterranean formation 326. Once the cement sheath 330 is broken and/or an initial route of fluid communication is established between the closed wellbore 328 and subterranean formation 326, further wellbore operations (e.g., plug and perforation operations or ball drop operations) may commence.

During one or more wellbore operations, each of the sleeves 320A-E depicted in FIG. 3 may generally operable between an open position and a closed position such that in the open position, the sleeves 320A-E allow communication of fluid between the tubular string 316 and the production zones 322A-E. In one or more embodiments, the sleeves 320A-E may be operable to control fluid in one or more configurations. For example, the sleeves 320A-E may operate in an intermediate configuration, such as partially open, which may cause fluid flow to be restricted, a partially closed configuration, which may cause fluid flow to be less restricted than when partially open, an open configuration which does not restrict fluid flow or which minimally restricts fluid flow, a closed configuration which restricts all fluid flow or substantially all fluid flow, or any position in between.

During production, fluid communication is generally from subterranean formation 326, through the sleeves 320A-E and electronic initiator sleeve 100 (for example, in an open configuration) and into tubular string 316. Communication of fluid may also be from tubular string 316, through the sleeves 320A-E and electronic initiator sleeve 100, and into the formation 326, as is the case during hydraulic fracturing. Hydraulic fracturing is a method of stimulating production of a well and generally involves pumping specialized fracturing fluids down the well and into the formation. As fluid pressure is increased, the fracturing fluid creates cracks and fractures in the formation and causes them to propagate through the formation. As a result, the fracturing creates additional communication paths between the wellbore 328 and the subterranean formation 326. Communication of fluid may also arise from other stimulation techniques, such as acid stimulation, water injection, and carbon dioxide ($CO_2$) injection.

Although well system 300 depicted in FIG. 3 comprises sleeves 320A-E and barriers 318A-E, it may comprise any number of additional downhole tools, including, but not limited to screens, flow control devices, slotted tubing, additional packers, additional sleeves, valves, flapper valves, baffles, sensors, and actuators. The number and types of downhole tools may depend on the type of wellbore, the operations being performed in the wellbore, and anticipated wellbore conditions. For example, in certain embodiments, downhole tools may include a screen to filter sediment from fluids flowing into the wellbore. In addition, although well system 300 depicted in FIG. 3 depicts fracturing tools, the methods and systems of the present disclosure may be used with any downhole tool or downhole operation.

An embodiment of the present disclosure is a method including: disposing an electronic initiator sleeve within a closed wellbore penetrating at least a portion of a subterranean formation, wherein the electronic initiator sleeve comprises: a housing having at least one port, a sleeve in a closed position, an actuator, and at least one sensor; increasing fluid pressure within the closed wellbore for a period of time, wherein the sleeve remains in the closed position during the period of time; detecting a signal with the at least one sensor; and actuating the actuator in response to the signal to transition the sleeve from the closed position to an open position.

Another embodiment of the present disclosure is an electronic initiator sleeve comprising: a housing comprising one or more ports; at least one sensor coupled to the housing; a sleeve disposed within the housing that is configured to transition from a closed position to an open position exposing the one or more ports; an actuator disposed within the housing, wherein the actuator actuates in response to detection of a signal by the at least one sensor and to maintain the sleeve in the closed position until actuated; and a shear pin that maintains the sleeve in the closed position until sheared.

Another embodiment of the present disclosure is a system comprising: a wellbore having a wellhead; a tubular string disposed within the wellbore and depending from the wellhead; an electronic initiator sleeve incorporated into the tubular string in a position farthest from the wellhead, wherein the electronic initiator sleeve comprises: a housing comprising one or more ports; at least one sensor coupled to the housing; an actuator disposed within the housing that actuates in response to detection of a signal by the at least one sensor; and a sleeve disposed within the housing that is configured to transition from a closed position to an open position upon actuation of the actuator.

What is claimed is:

1. A method comprising:

disposing an electronic initiator sleeve within a closed wellbore penetrating at least a portion of a subterranean formation, wherein the electronic initiator sleeve comprises:

a housing having at least one port, a sleeve in a closed position, an actuator, at least one sensor, an electro-hydraulic lock coupled to the actuator that maintains the sleeve in the closed position until removed, and a hydraulic chamber isolated from fluid within the closed wellbore;

increasing fluid pressure within the closed wellbore for a period of time, wherein the sleeve remains in the closed position during the period of time;

detecting a signal with the at least one sensor; and actuating the actuator in response to the signal to transition the sleeve from the closed position to an open position.

2. The method of claim 1, wherein the at least one port is exposed when the sleeve transitions from the closed position to the open position, and wherein a route of fluid communication between the closed wellbore and the subterranean formation is established through the at least one port.

3. The method of claim 2, wherein the route of fluid communication is an initial route of fluid communication established between the closed wellbore and the subterranean formation.

4. The method of claim 1, wherein the closed wellbore comprises a cement sheath that is substantially unbroken when the electronic initiator sleeve is disposed within the closed wellbore.

5. The method of claim 4, wherein the cement sheath is broken after the sleeve transitions from the closed position to the open position.

6. The method of claim 1, wherein the electronic initiator sleeve further comprises:

a shear pin that maintains the sleeve in the closed position until sheared.

7. The method of claim 1, wherein the electro-hydraulic lock is removed by actuating the actuator in response to the signal.

8. The method of claim 1, wherein the signal comprises a pulse signal, a discrete threshold signal, a series of discrete threshold signals over time, a series of ramping signals over time, a pulse width modulated signal, a signal profile, or any combination thereof.

9. The method of claim 1, wherein the signal is generated by adjusting one or more of a pressure in the closed wellbore, a temperature in the closed wellbore, a pH in the closed wellbore, a flow rate in the closed wellbore, an acoustic vibration in the closed wellbore, a magnetic field in the closed wellbore, an electromagnetic field in the closed wellbore, or any combination thereof.

10. The method of claim 1, wherein the electronic initiator sleeve further comprises on-board electronics, and wherein the method further comprises:

sending an electrical signal from the sensor to the on-board electronics based on the detected signal; and sending an actuation signal from the on-board electronics to the actuator based on the electrical signal.

11. The method of claim 10, wherein there is a time delay between sending the electrical signal from the sensor to the on-board electronics and sending the signal from the on-board electronics to the actuator.

12. An electronic initiator sleeve within a closed wellbore comprising:

a housing comprising one or more ports;

at least one sensor coupled to the housing;

a sleeve disposed within the housing that is configured to transition from a closed position to an open position exposing the one or more ports;

an actuator disposed within the housing, wherein the actuator actuates in response to detection of a signal by the at least one sensor and maintains the sleeve in the closed position until actuated;

a shear pin that maintains the sleeve in the closed position until sheared, an electro-hydraulic lock coupled to the actuator that maintains the sleeve in the closed position until removed, and a hydraulic chamber isolated from fluid within the closed wellbore.

13. The electronic initiator sleeve of claim 12, wherein the electro-hydraulic lock is removed upon actuation of the actuator.

14. The electronic initiator sleeve of claim 12, wherein the electro-hydraulic lock comprises a rupture disk and a piercing mechanism that ruptures the rupture disk upon actuation of the actuator to remove the electro-hydraulic lock.

15. The electronic initiator sleeve of claim 12, wherein the at least one sensor comprises a pressure sensor, a temperature sensor, a pH sensor, a flow sensor, a hydrophone, a vibrational sensor, an acoustic sensor, an accelerometer, a piezoelectric sensor, a strain gauge, or any combination thereof.

16. A system comprising:

a wellbore having a wellhead;

a tubular string disposed within the wellbore and depending from the wellhead;

an electronic initiator sleeve incorporated into the tubular string in a position farthest from the wellhead, wherein the electronic initiator sleeve comprises:

a housing comprising one or more ports;

at least one sensor coupled to the housing;

an actuator disposed within the housing that actuates in response to detection of a signal by the at least one sensor;

a sleeve disposed within the housing that is configured to transition from a closed position to an open position upon actuation of the actuator;

an electro-hydraulic lock coupled to the actuator that maintains the sleeve in the closed position until removed, and a hydraulic chamber isolated from fluid within the closed wellbore.

17. The system of claim 16, wherein the electronic initiator sleeve further comprises on-board electronics coupled to the sensor and the actuator.

18. The system of claim 16, wherein the at least one sensor comprises a pressure sensor, a temperature sensor, a pH sensor, a flow sensor, a hydrophone, a vibrational sensor, an acoustic sensor, an accelerometer, a piezoelectric sensor, a strain gauge, or any combination thereof.

19. The system of claim 16, further comprising at least one downhole tool incorporated into the tubular string.

20. The system of claim 16, wherein the electronic initiator sleeve further comprises:

a shear pin coupled to the housing that maintains the sleeve in the closed position until sheared.

* * * * *